US005256121A

United States Patent [19]

Brotman

[11] Patent Number: 5,256,121

[45] Date of Patent: Oct. 26, 1993

[54] AUXILIARY MAGNETIC WEIGHTS

[76] Inventor: Eric M. Brotman, Box 1061, Nevada City, Calif. 95959

[21] Appl. No.: 747,759

[22] Filed: Aug. 19, 1991

Related U.S. Application Data

[63] Continuation-in-part of Ser. No. 471,421, Jan. 29, 1990, Pat. No. 5,040,787, which is a continuation of Ser. No. 306,894, Feb. 6, 1989, abandoned.

[51] Int. Cl.[5] ..... A63B 21/072

[52] U.S. Cl. ..... 482/93; 482/106; 482/108

[58] Field of Search ..... 482/93, 105, 106, 108; 24/303; 446/129; 128/75

[56] References Cited

U.S. PATENT DOCUMENTS

| | | | |
|---|---|---|---|
| 272,144 | 2/1883 | McGinnis | 482/108 |
| 2,731,663 | 1/1956 | Thompson | 24/303 X |
| 2,752,764 | 7/1956 | Lederer | 24/303 X |
| 2,935,662 | 5/1960 | Hausmann | 24/303 X |
| 2,965,996 | 12/1960 | Hughes | 446/129 X |
| 3,122,684 | 2/1964 | Genn | 446/129 X |
| 3,141,216 | 7/1964 | Brett | 24/303 |
| 3,171,652 | 3/1965 | Newman | 486/106 |
| 3,196,566 | 7/1965 | Littlefield | 446/129 X |
| 3,254,440 | 6/1966 | Dugoak | 446/129 X |
| 3,330,012 | 7/1967 | Hart et al. | 24/303 X |
| 3,606,314 | 9/1971 | Popp | 446/129 X |
| 3,664,039 | 5/1972 | DeRist | 446/129 |
| 3,755,857 | 9/1973 | Simoneaux | 24/330 X |
| 4,031,652 | 6/1977 | Johnson | 24/303 X |
| 4,211,414 | 7/1980 | Moodt | 446/129 X |
| 4,250,596 | 2/1981 | Hara et al. | 24/303 X |
| 4,382,302 | 5/1983 | Watson | 482/105 X |
| 4,432,504 | 2/1984 | Pale | 24/303 X |
| 4,462,596 | 7/1984 | Yamamoto | 446/129 X |
| 4,576,150 | 3/1986 | Auracher | 128/75 |
| 4,632,389 | 12/1986 | Moss | 482/105 |
| 4,693,921 | 9/1987 | Billarant et al. | 24/303 X |
| 4,712,793 | 12/1987 | Harwick et al. | 482/93 X |
| 4,787,628 | 11/1988 | Harwick et al. | 482/93 X |
| 5,014,981 | 5/1991 | Prelich | 482/106 X |

*Primary Examiner*—Robert Bahr

[57] ABSTRACT

An auxiliary weight system for use with weight exercising apparatus such as free weights or weight stack machines. The auxiliary weights include magnets for releasably attaching the auxiliary weights to vertical surfaces of the main weights forming a part of the weight exercising apparatus. The auxiliary weights are formed with small weight values and may be magnetically secured to the main weights to change the aggregate weight value being lifted by small amounts. The auxiliary weights may be stored by magnetically affixing them to existing racks or framework associated with the weight exercising apparatus.

1 Claim, 2 Drawing Sheets

AUXILIARY MAGNETIC WEIGHTS

This is a continuation-in-part of patent application Ser. No. 07/471,421 filed Jan. 29, 1990, now U.S. Pat. No. 5,040,787 which is a continuation of Ser. No. 07/306,894 filed Feb. 6, 1989, now abandoned.

BACKGROUND OF THE INVENTION

The present invention relates to exercise apparatus such as used for weight lifting, for body building, or for physical therapy and rehabilitation purposes.

Exercise apparatus of this sort frequently includes weights which are lifted or moved in such a way as to stress the user's muscles and thus to aid in developing or maintaining muscle strength, tone and quality. Familiar examples include so-called free weights—dumbbells and barbells—and weight machines including so-called machine stack weights. Such apparatus is found in health clubs and gymnasiums for maintaining health and fitness and in physical therapy and rehabilitation centers for those recovering from injury.

Most such weights may only be varied in predetermined increments. Free weights are typically stored on racks, which hold a variety of smaller weights which serve as building blocks to build up the total weight desired to be lifted or which may hold a separate barbell or dumbbell for each total weight. In any event the weight to be lifted may be varied only in fixed increments of typically five or ten pounds. The weights of the "machine stack weight" type of apparatus are built into the apparatus and similarly may only be varied in fixed increments of ten pounds. Thus a deficiency in such exercise apparatus is that the user has limited ability to adjust the increment with which the weight may be increased or decreased. Manufacturers have been unwilling in the past to supply weights in smaller and smaller increments undoubtedly for a variety of reasons. The cost of the additional apparatus would strain the budgets of typical health clubs or exercise facilities, or it would take too much space to store the additional weights or incorporate them into the stacks of the machine stack weights, or in some cases a small incremental weight, such as a fraction of a pound, may not be able to be incorporated into the apparatus with sufficient structural integrity for reliable and safe use.

A disadvantage of known weight apparatus is that users may experience excessive strain and be subject to injury because they must increase the weights in too great an increment. For example, progressing from a fifteen pound pair of dumbbells to a twenty pound pair represents a 33% increase in workload. For some users, particularly those in physical therapy trying to recover from injury, a 33% step may be too large, but this is all that is possible with the readily available equipment.

U.S. Pat. Nos. 3,758,109, 4,453,710, 4,531,728 and 4,712,793 disclose exercise equipment having auxiliary weights to permit gradual increase in the aggregate weight being lifted. The auxiliary weights of these patents, however, are useful only with the specific equipment for which they were designed. Such specialized auxiliary weights are not practical for most exercise facilities precisely because they are limited to use with the one piece of apparatus. While it might be cost effective to buy one set of auxiliary weights to be used with all apparatus, it generally will not be cost effective to buy separate sets of auxiliary weights to be used with each difference piece of apparatus in the exercise facility.

SUMMARY OF THE INVENTION

The present invention provides an auxiliary weight system generally overcoming the above disadvantages of the prior art. The auxiliary weights may be used without modification with a variety of exercise apparatus of different constructions to permit the user to vary the weight employed by substantially any desired small increment.

The incremental weights of the invention may be used with free weights, barbells, dumbbells, weight stack machines, or specialized weight exercise contrivances used for physical therapy or rehabilitation purposes. These devices share the common feature that they include a weighted member which presents a generally vertical surface during use, a portion of which is subject to magnetic attraction. Briefly, an auxiliary incremental weight according to the invention includes a magnet and a magnetically active contact member which has a surface formed for engagement with the generally vertical surface of the weight exercise apparatus. The contact member is in magnetic contact with the magnet and so is itself magnetic to present a magnetic attraction to the vertical surface. The magnet and contact member are mounted in a housing. The auxiliary weights are used by simply affixing them to the vertical surface of the weight being lifted by the magnetic attraction. These weights may be made quite small in weight value so that the aggregate weight to be lifted may be varied in small increments. Because of the magnetic attraction, the auxiliary weights may be conveniently stored when not in use by magnetically affixing them to unobstructed frame members of existing racks for holding barbells and dumbbells, for example, or by magnetically affixing them to the frame of a weight stack machine.

Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
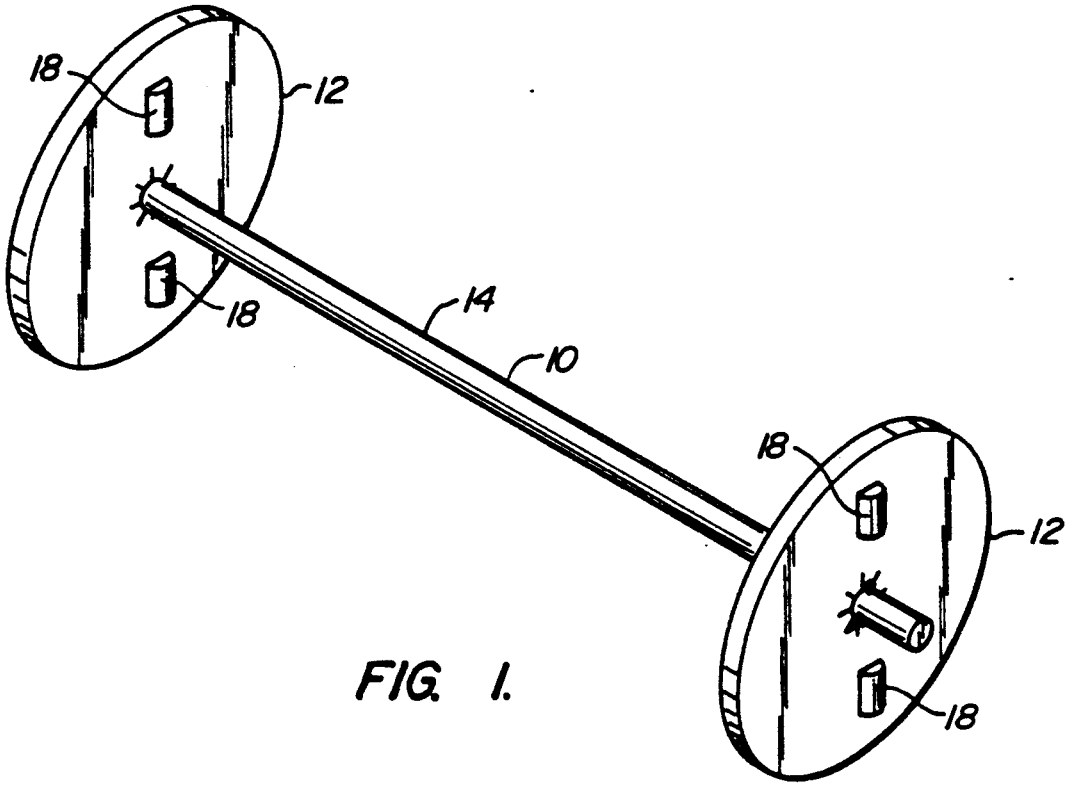
FIG. 1 is an isometric view of a dumbbell employing an auxiliary weight of the present invention.

A specific embodiment of the invention is now described with reference to the figures. FIG. 1 shows a barbell, indicated generally at reference numeral 10, which includes a pair of weights 12 mounted on a crossbar 14. Weights 12 are conventionally supplied in fixed increments of five or ten pounds. These increments may be excessive for some individuals or for certain workout routines. For example, for persons using weights in physical therapy to recover from an injury it may be desired to increase the weight more gradually, i.e., in smaller increments, to obtain the optimal benefits of the therapy. Similarly, in certain exercise routines athletes may want to perform successive repetitions of an exercise quickly increasing or decreasing the weight in small increments from a lighter to a heavier weight or a heavier to a lighter weight. For this purpose auxiliary weights 18 are provided having embedded magnets 20 to permit the auxiliary weights 18 to be releasably attached to weights 12 of the barbell 10. Auxiliary weights 18 are provided in small increments such as ¼, ½, 1, 2 or 3 pounds, although greater auxiliary weights may also be used. Furthermore, if desired, two or more auxiliary weights 18 may be mounted on the main weights 12 of the barbell, as seen in FIG. 1. In this manner the total weight of the barbell 10 can be varied substantially as desired, for example, in quarter-pound intervals.

Figure 2:
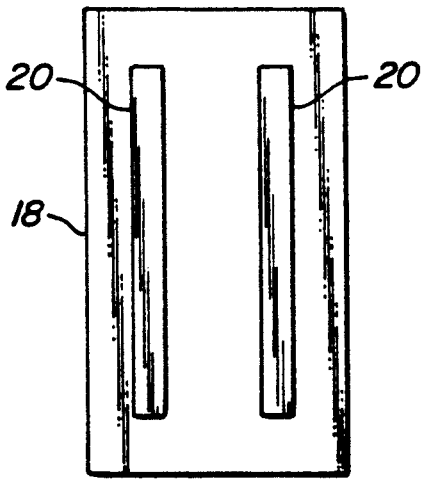
FIG. 2 is a front elevational view of an auxiliary weight according to the invention.
Figure 3:
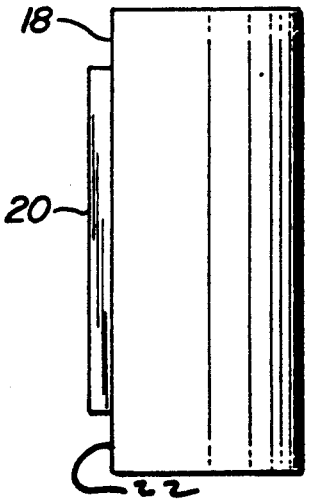
FIG. 3 is a side elevational view of the auxiliary weight of FIG. 1.

As seen in FIGS. 2 and 3, auxiliary weights 18 are formed generally in the shape of a flat-sided cylinder or bar and have a pair of generally elongated bar magnets 20 embedded in the flat surface 22 and protruding slightly from surface 22, as best seen in FIG. 3.

Figure 4:
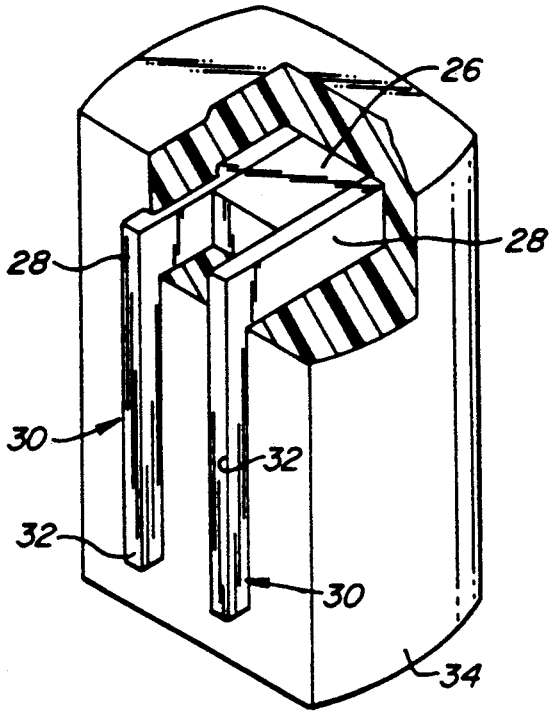
FIG. 4 is a cut-away perspective view showing an auxiliary weight according to the invention.

The construction of the magnetic weights may be seen in the cut-away perspective view of FIG. 4. Magnet 20 may be formed from a permanently magnetized member 26 which is associated with a means for providing a contact surface for engagement with the principal weights 12. In FIG. 4 the contact surface is defined by a pair of thin steel rectangular members or plates 28. Permanent magnet 26 is formed with two parallel surfaces which each engage one of the steel plates 28. The plates 28 are arranged parallel to one another, and their outermost edges 30 are also formed to be parallel to one another and generally flat so as to define contact surface 32 for engagement with the principal weights 12. The edges 30 of plates 28 extend a certain distance beyond the outer edge of permanent magnet 26. The assembly of magnet 26 and plates 28 should have a magnetic strength sufficient to maintain the auxiliary weight in engagement with the generally vertical surface during the movement encountered during use. Given the benefit of this disclosure, those skilled in the art will readily be able to determine empirically the strength of magnetic attraction needed for any desired aggregate weight value.

Magnet 26 and plates 28 form a sandwich structure, in which the magnet is sandwiched between two steel pole pieces. Although not necessary for the practice of the present invention, the sandwich structure is nevertheless a preferred one. It is known to persons skilled with magnets that the sandwich structure concentrates the attractive force of the magnet at the pole pieces and thereby greatly increases the holding power of the magnet 26. In the present usage a greater holding power is desirable so that the auxiliary weights will not be thrown from the principal weights during the rapid and erratic movements encountered during an exercise routine. At the same time it is desirable to keep the size of the auxiliary weight small so that it will fit more readily on the limited surface area available on most weight apparatus. The sandwich structure helps to meet both of these goals. An auxiliary weight with sufficient holding power to withstand the jerks and tugs of an exercise routine may be formed, for example, of a barium ferrite ceramic magnet as the magnet 26 with the steel pole pieces 28 as described above. In addition, it is more economical to use more of the less costly unmagnetized steel and less of the more costly permanent magnet. In the embodiment illustrated in FIG. 4, for example, it is relatively easy to fabricate the plates 28 because of their simple rectangular shape, and the flat contact surface 32 is easy to form. It is also simpler and less costly to assemble the plates 28 with the surfaces 32 parallel to one another than it would be to fabricate an integral unit or more complex shaped unit. It is also easier, of course, to work with unmagnetized materials during the manufacturing and assembly process.

The contact surface 30 described above was defined by the edges of the steel plates 28, but other means may also be used. Although it may be more economical and provide greater holding power to define the contact surface from initially unmagnetized, yet magnetizable pole pieces, other constructions may also be employed. Whatever configuration or construction is employed, however, it is necessary for the practice of the method of the present invention that the means defining contact surface 32 provide a magnetic attraction to the surface of the principal weight to which it is intended to be affixed. The contact surface may itself be a permanent magnet or it may be formed of a magnetizable material such as an iron, steel or nickel alloy which forms a magnet when brought in engagement with the permanent magnet 26. The means defining the contact surface is thus described as being "magnetically active" or "magnetically responsive."

Magnet 26 and the means 28 defining the contact surface are included within a housing 34. The housing may be formed initially with a cavity for receiving the magnet and means 28, which may be secured within cavity by an appropriate plastic, epoxy resin or similar material. Such materials are well known and need not be described in any detail here. In the assembled configuration the outer edges 30 of plates 28 extend beyond the surface 38 of the housing. Arranged in this manner, protruding edges 30 act as a "fulcrum" to assist in removing the auxiliary weight from the surface of the principal weight to which it is adhered. The user simply grasps the housing and turns the auxiliary weight while "rocking" it slightly on the fulcrum formed by edges 30. Despite a strong magnetic attraction sufficient to hold the auxiliary weight in position against the jerks and tugs encountered during exercise, this movement easily separates the auxiliary weight from its supporting principal weight.

In use, a plurality of auxiliary weights 18 are provided in a range of weight values intermediate between the standard "fixed" weight values of the exercise equipment. When it is desired to alter the weight of a particular exercising device, such as the barbell 10 of FIG. 1, one or more of the auxiliary weights 18 are selected to provide the desired weight variation. The selected auxiliary weights are attached to the desired exercising device by placing the magnets 20 of the auxiliary weights in proximity with the main weights of the exercising device, usually against a vertical surface of the main weights of the device. This will increase the effective weight of the device by the desired amount and the user can proceed to exercise without fear of exceeding the appropriate weight for the user's level of development.

Figure 5:
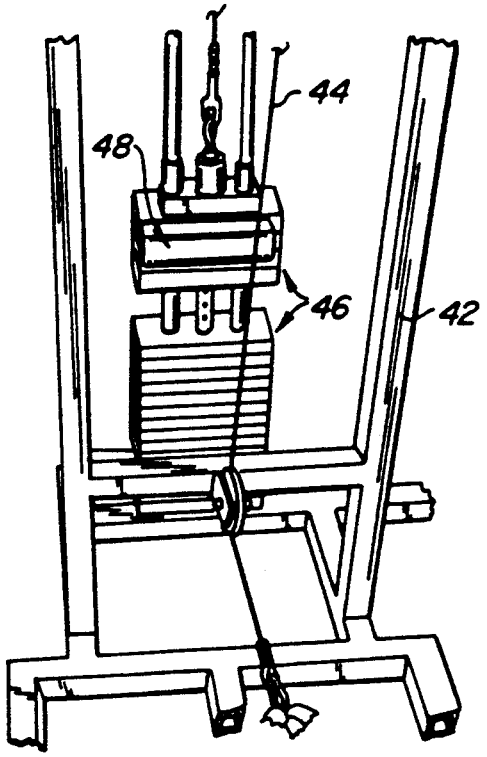
FIG. 5 is a perspective view of a weight stack apparatus employing an auxiliary weight according to the invention.

The auxiliary weights of the invention may also be used to advantage with the exercise apparatus known generally as weight stack machines. This type of apparatus, illustrated in FIG. 5, includes a frame 42 and a cable 44 which is trained over one or more pulleys and guides. The user pulls on one end of the cable. The other end of the cable is coupled to an adjustable stack of weights, indicated generally at reference numeral 46. The stack 46 typically includes a plurality of weight plates, each of a designated weight, which is typically ten pounds. The user adjusts the weight to be lifted by coupling a selected number of weight plates to the cable. The resulting aggregate weight may be varied, of course, only in increments of ten pounds. Weight stack type of apparatus, however, lends itself to use with the present invention to achieve smaller incremental weight variations. The individual weight plates, when stacked together, provide a vertical surface which generally presents a greater unobstructed surface area than the top of the weight stack. The auxiliary weights of the present invention may simply be magnetically affixed to the vertical surface of the stacked weights in whatever increment is desired, such as illustrated at reference numeral 48.

Figure 6:
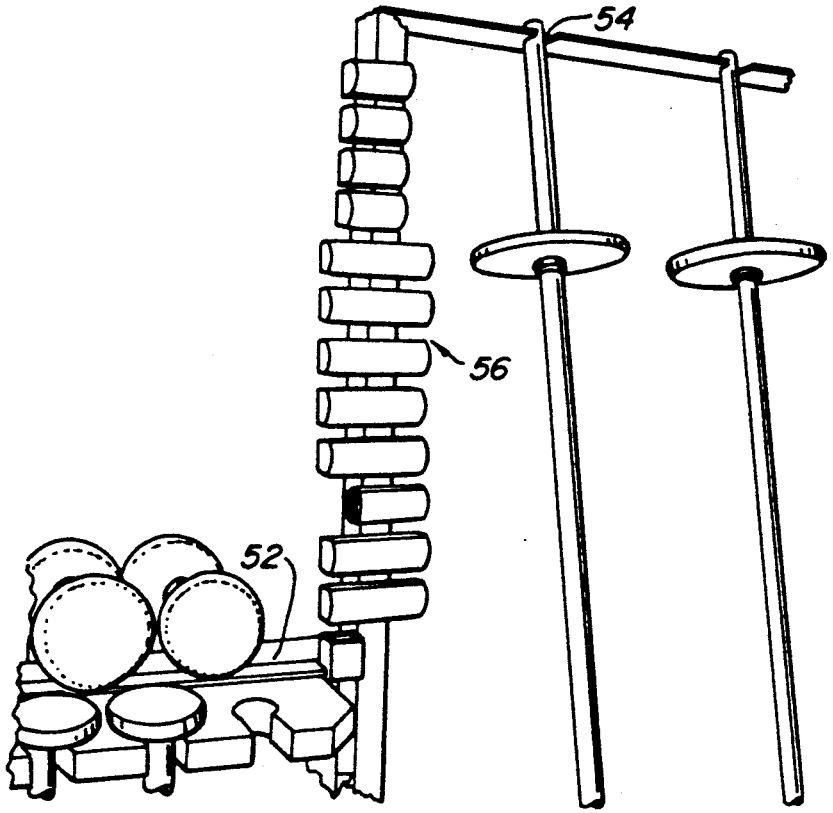
FIG. 6 is a perspective view of a weight rack for storing auxiliary weights according to the invention.

The auxiliary weights may be conveniently stored when not in use. Sets of free weights typically include a rack, such as illustrated in FIG. 6, for holding the weights when not in use. The racks usually include a frame with rails 52 or detents 54 for holding the free weights. Such racks may be formed with an extended frame member of a magnetically responsive composition such as iron or steel having an unobstructed stretch. The auxiliary weights may simply be magnetically attached to the unobstructed frame member such as shown at reference numeral 56 in FIG. 6. The weight stack type of exercise machines will generally include a frame with such an unobstructed iron or steel member, which also may be used for storing auxiliary weights when not in use.

While the above provides a full and complete disclosure of illustrative embodiments of the invention, various modifications, alternate constructions, and equivalents may also be employed to achieve the advantages of the invention. Therefore, the invention is not to be limited to the above illustrative embodiments, but is defined by the appended claims.

What is claimed is:

1. An incremental weight for use with graduated weight exercise apparatus of the type including a weight of specified weight value disposed to present a generally vertical surface during use, the vertical surface having a portion subject to magnetic attraction, said incremental weight comprising:

a magnet and a magnetically active contact member in contact with said magnet, said contact member being formed of a pair of generally rectangular parallel plates presenting a pair of parallel edges, said edges defining an engagement surface for engaging the generally vertical surface of the weight, and said magnet being sandwiched between said plates; and an elongate housing, having a substantially flat bottom portion and a convexly curved top portion of generally cylindrical-sector shape with cylinder axis along the long dimension of said elongate housing, said housing being dimensioned to be held in the user's hand to provide a grip for the user, wherein said magnet and said pair of parallel plates are fixed within said housing such that said pair of parallel edges protrudes from said substantially flat bottom portion of said housing so as to define an offset of said engagement surface from said housing;

wherein said incremental weight has an overall weight value greater than about one-quarter pound and less than about three pounds, and wherein said magnet has a magnetic strength sufficient to maintain said incremental weight in engagement with the generally vertical surface during the movement encountered during use of the weight exercise apparatus.

* * * * *